US005741631A

United States Patent [19]

Twist

[11] Patent Number: 5,741,631

[45] Date of Patent: Apr. 21, 1998

[54] PHOTOGRAPHIC DYE IMAGE-FORMING PROCESS

[75] Inventor: Peter Jeffery Twist, Gr. Missenden, United Kingdom

[73] Assignee: Eastman Kodak Company, Rochester, N.Y.

[21] Appl. No.: 781,144

[22] Filed: Jan. 9, 1997

[30] Foreign Application Priority Data

Jan. 10, 1996 [GB] United Kingdom ..... 9600409

[51] Int. Cl.[6] ..... G03C 7/44

[52] U.S. Cl. ..... 430/399; 430/372; 430/373; 430/414; 430/428; 430/429; 430/465; 430/466; 430/490; 430/943

[58] Field of Search ..... 430/373, 399, 430/414, 465, 943, 372, 428, 429, 466, 490

[56] References Cited

U.S. PATENT DOCUMENTS

| | | | |
|---|---|---|---|
| 4,311,574 | 1/1982 | Ishikawa | 204/180 P |
| 4,816,384 | 3/1989 | Fruge et al. | 430/465 |
| 4,997,749 | 3/1991 | Wernicke et al. | 430/434 |
| 5,319,410 | 6/1994 | Glover et al. | 354/324 |
| 5,324,624 | 6/1994 | Twist | 430/943 |
| 5,358,830 | 10/1994 | Twist | 430/943 |
| 5,376,509 | 12/1994 | Yoshimoto et al. | 430/465 |
| 5,387,499 | 2/1995 | Earle et al. | 430/373 |
| 5,436,118 | 7/1995 | Carli et al. | 430/400 |
| 5,556,736 | 9/1996 | Haraguchi et al. | 430/465 |
| 5,587,277 | 12/1996 | Yamashita et al. | 430/465 |

FOREIGN PATENT DOCUMENTS

| | | |
|---|---|---|
| 0 654 707 A1 | 10/1993 | European Pat. Off. . |
| 0 706 085 A1 | 10/1994 | European Pat. Off. . |
| 2 302 596 | 6/1995 | United Kingdom . |
| 91/12567 | 2/1990 | WIPO . |

*Primary Examiner*—Hoa Van Le
*Attorney, Agent, or Firm*—J. Lanny Tucker

[57] ABSTRACT

A process for the formation of a dye image by a redox amplification process in an imagewise exposed photographic color material having at least one silver halide layer and associated therewith a dye image-forming color coupler, comprises treating the material in a color developer solution containing a color developing agent and hydroxylamine as developing agent preservative. The color developing solution is replenished directly as solids or liquid concentrates with or without additional water. The process is carried out in a tank in which the ratio of the tank volume to maximum area of material accommodatable therein is less than 11 $dm^3/m^2$.

20 Claims, 1 Drawing Sheet

PHOTOGRAPHIC DYE IMAGE-FORMING PROCESS

FIELD OF THE INVENTION

This invention relates to a photographic dye image-forming process.

BACKGROUND OF THE INVENTION

It is desirable to reduce the volume of replenisher solutions added to processing solutions so as to reduce overflow from processes and hence reduce waste and pollution. It is also desirable to add chemicals in concentrated form, even as solids, so that transport and packaging costs can be minimized. However, the minimum practical limits of replenishment volume are set, not by the upper limits of concentration of chemicals added, but by other considerations such as the maximum tolerable concentrations of materials produced or released during processing.

The use of small volumes of replenisher results in a slow rate of replacement of tank solutions during processing. Particularly when processors are working at less than full throughput and/or are used intermittently, this can lead to problems due to the aging of solutions and interactions with the atmosphere leading to undesirable precipitates or loss of activity.

Typically photographic color developer solutions that are in use today lose activity by aerial oxidation of the color developing agent, but typically will be stable for a week or two. To achieve this, hydroxylamine or one of its substituted derivatives such as diethylhydroxylamine are used as antioxidants (or preservatives) for solutions containing color developing agents.

Systems of largely solid chemical replenishment have been described for conventional color development processes in conventional developing tanks.

Redox amplification (RX) processes have been described, for example in British Specification No. 1,268,126, U.S. Pat. No. 3,748,138, U.S. Pat. No. 3,822,129 and U.S. Pat. No. 4,097,278. In such processes color materials are developed to produce a silver image (that may contain only small amounts of silver) and are treated with a redox amplifying solution (or a combined developer/amplifier) to form a dye image.

Developer/amplifier solutions are known to deteriorate particularly rapidly because they contain both an oxidizing agent (e.g., hydrogen peroxide) and a reducing agent (the color developing agent) that react together spontaneously thus leading to loss of activity in a matter of an hour or two.

European Publication 0 654 707 describes the surprising improvements in stability that occur when a conventional substituted hydroxylamine antioxidant is replaced by unsubstituted hydroxylamine. It describes an effect whereby hydrogen peroxide and hydroxylamine react together but that in a balanced way whereby the sensitometry of the processed material is maintained.

Unfortunately though, with such a formulation, the hydroxylamine replenisher concentrate is much more unstable than a similar concentrate based on a substituted hydroxylamine.

The problem to be solved is to provide RX processes using hydroxylamine as the color developing agent preservative with the advantages of adding components in as concentrated a form as possible without the processing solutions or their replenishers undergoing undesirable loss of activity due to modest usage.

SUMMARY OF THE INVENTION

According to the present invention there is provided a process for the formation of a dye image by a redox amplification process in an imagewise exposed photographic color material having at least one silver halide layer and associated therewith a dye image-forming color coupler, the process comprising treating the material in a processing tank containing a color developer solution containing a color developing agent and hydroxylamine as developing agent preservative, and wherein the color developer solution is replenished with a color developer replenisher, the process being carried out in a tank in which the ratio of the tank volume to maximum area of material accommodatable therein is less than 11 $dm^3/m^2$, and the color developer replenisher is added as solids or liquid concentrates directly to the developer solution with or without additional water.

The combination of the low volume tank and the addition of solid or concentrated liquid replenishers directly into the developing tank provides environmentally desirable minimal replenishment without suffering undue loss of activity of the processing solution or its replenishers in redox amplification processes without loss of activity during periods of intermittent use.

DETAILED DESCRIPTION OF THE INVENTION

Figure 1:
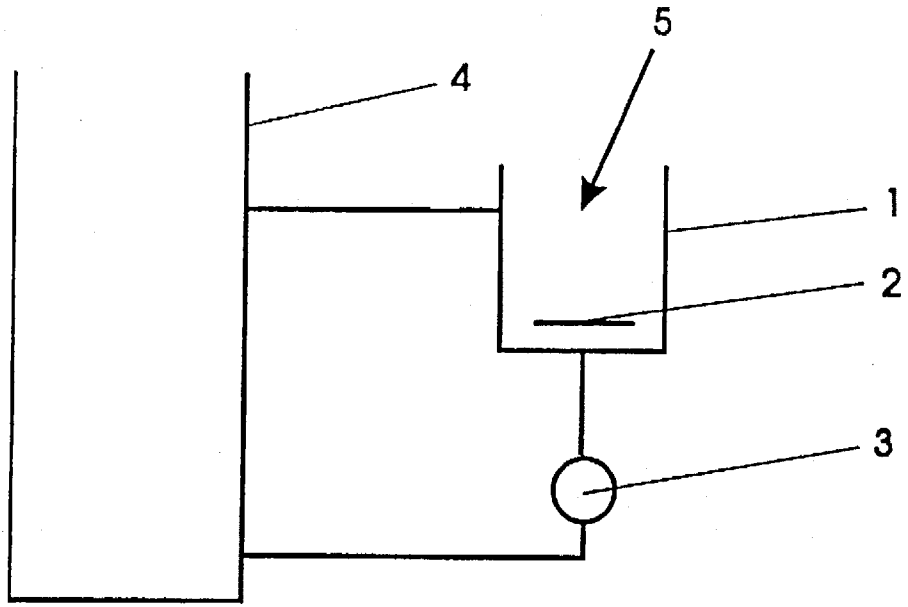
FIG. 1 is a schematic diagram showing the method of adding solids to a processing solution.

Preferably the color developing agent-containing processing solution is recirculated through the tank.

The hydroxylamine may be in the form of a salt thereof such as hydroxylamine chloride, phosphate or, preferably, sulphate.

The pH is preferably buffered, e.g., by a phosphate such as tripotassium hydrogen phosphate ($K_2HPO_4$) or by another phosphate, or carbonate, silicate or mixture thereof.

The material being processed is preferably a color negative paper material.

The material may comprise the emulsions, sensitizers, couplers, supports, layers, additives, etc. described in Research Disclosure, December 1978, Item 17643, published by Kenneth Mason Publications Ltd., Dudley Annex, 12a North Street, Emsworth, Hants P010 7DQ, U.K.

In a preferred embodiment the photographic material comprises a resin-coated paper support and at least one of the emulsion layers comprise more than 80 mol %, preferably more than 90 mol % silver chloride and are more preferably composed of substantially pure silver chloride.

The redox amplification (RX) process may be carried out in separate developer and amplifier solutions or in a combined developer/amplifier solution.

The preferred oxidant for the RX process is hydrogen peroxide or a material that provides hydrogen peroxide.

The hydrogen peroxide replenisher may be added as a solution of hydrogen peroxide or as a solid which provides hydrogen peroxide to the solution.

The pH of the developer/amplifier may be in the range of from 9.5 to 12. Preferably the pH is in the range from 10 to 12, particularly from 10 to 11.7.

The developer/amplifier solution may contain a buffering alkali material. Examples of such materials are alkali metal carbonates and phosphates, for example sodium or potassium carbonates or phosphates. Additional alkali may also be present, e.g., an alkali metal hydroxide. The carbonates may be present in the solution in amounts of 10 to 60 g/l, preferably 15 to 45 g/l, and particularly 20 to 30 g/l as potassium carbonate while the phosphates may be present in the solution in amounts of 20 to 80 g/l, preferably 25 to 65 g/l, and particularly 30 to 50 as potassium phosphate.

In addition to the hydroxylamine antioxidant, the developer/amplifier may contain a long chain compound that can adsorb to silver, e.g., dodecylamine. This has the effect of improving solution stability further.

The solution may contain from 1 to 12 g/l of color developing agent, and preferably from 3 to 8 g/l.

The preferred color developing agents are p-phenylenediamines, for example:

4-amino-3-methyl-N,N-diethylaniline hydrochloride,
4-amino-3-methyl-N-ethyl-N-b-(methanesulphonamido)-ethylaniline sulphate hydrate,
4-amino-3-methyl-N-ethyl-N-b-hydroxyethylaniline sulphate,
4-amino-3-b-(methanesulphonamido)ethyl-N,N-diethylaniline hydrochloride,
4-amino-N-ethyl-N-(2-methoxy-ethyl)-m-toluidine di-p-toluene sulphonate, and especially
4-N-ethyl-N-(b-methanesulphonamidoethyl)-o-toluidine sesquisulphate (known as CD3).

The concentration range of the hydrogen peroxide is preferably from 0.5 to 7 ml/l and especially from 0.5 to 2 (as 30% w/w solution).

The concentration range of the hydroxylamine component is from 0.5 to 8 and especially from 0.5 to 2 g/l (as hydroxylamine sulphate).

The pH is preferably in the range 11 to 11.7 and especially from 11 to 11.4.

The composition is preferably free of any compound that forms a dye on reaction with oxidized color developer.

The replenisher concentrates may contain components at high concentrations up to their limit of solubility.

The relative proportions of hydrogen peroxide (as ml/l of a 30% w/w solution) and hydroxylamine compound (as g/l hydroxylamine sulphate) need to be balanced to give the required result.

In the redox amplification process used, the photographic material may be first subjected to a development step with a developer solution containing no peroxide or other oxidizing agent and then to a separate amplification step. Alternatively, the development and amplification may be combined in a single step using a combined developer/amplifier solution.

Preferably the dye image is formed in a combined developer/amplifier solution containing the color developing agent, the hydroxylamine and a redox oxidant.

The color photographic material to be processed may be of any type but will preferably contain low amounts of silver halide. Preferred total silver halide coverages are in the range 6 to 300, preferably 10 to 200 mg/m$^2$ and particularly 10 to 100 mg/m$^2$ (as silver).

A particular application of redox amplification is in the processing of silver chloride color paper, for example, paper comprising at least 85 mole % silver chloride, especially such paper with low silver levels for example levels below 100 mg/m$^2$ preferably in the range 50 to 90 mg/m$^2$.

The material may comprise the emulsions, sensitizers, couplers, supports, layers, additives, etc. described in Research Disclosure, December 1978, Item 17643, published by Kenneth Mason Publications Ltd., Dudley Annex, 12a North Street, Emsworth, Hants P010 7DQ, U.K.

In a preferred embodiment the photographic material to be processed comprises a resin-coated paper support and the emulsion layers comprise more than 80%, preferably more than 90% silver chloride and are more preferably composed of substantially pure silver chloride.

The photographic materials can be single color materials or multicolor materials. Multicolor materials contain image dye forming or image dye releasing units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolor photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

As stated above, the process of the invention employs a tank of relatively small volume and in a preferred embodiment the ratio of the tank volume to maximum area of material accommodatable therein (i.e., maximum path length times width of material) is less than 11 dm$^3$/m$^2$, preferably less than 3 dm$^3$/m$^2$.

Low volume processing tanks have been described in U.S. Pat. No. 5,436,118 that generally describes such tanks in combination with replenishment systems wherein chemicals are added in a liquid but concentrated form.

The process may be carried out in what is known in the art as a minilab for example the tank volume may be below 5 liters and sometimes below 3.0 liters conveniently in the range 1.5 to 2.5 liters and may be about 1 liter.

Solid replenishment is a convenient, accurate and consistent means of maintaining a developer and is ideally suited to be used in combination with RX developers, low volume tanks and minimum replenishment rates. The replenishers contain components such as chelating agents and hydrogen peroxide that have traditionally been available as solutions. All these are available as solids, AC5 is available as the solid sodium salt (although it has to be converted to the potassium salt because the mixed calcium/sodium salt is prone to precipitate in developer solutions), AC8 is available as the solid free acid, "pentetic acid" and the hydrogen peroxide can be supplied as the urea:hydrogen peroxide addition compound. Experiments have shown that urea has no effect on the performance or stability of the RX developers so constituted. Thus the replenishment may be accomplished entirely by the addition of solids plus water or in part by the addition of some solids and some solutions.

The material to be processed is conveniently passed through the tank and preferably the developer solution is recirculated through the tank at a rate of 0.1 to 10 tank volumes per minute. The preferred recirculation rate is from 0.5 to 8 especially from 1 to 5 and particularly from 2 to 4 tank volumes per minute.

The recirculation with or without replenishment may be carried out continuously or intermittently. In one method of working both can be carried out continuously while processing is in progress but not at all or intermittently when the tank is idle.

Replenishment may be carried out by introducing the required amount of replenisher into the recirculation system. For the addition of solid materials to the processing solution these can conveniently be added to the solution in the form of individual or composite pellets in the filter housing just before it passes through the filter. This is shown in 4 in which filter housing (1) contains a filter member (2) through which processing solution passes before being pumped by pump (3) into the processing tank (4). The solids and water are added directly to the filter housing as shown by arrow (5).

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution of less then 11 mm, preferably less than 5 mm and especially about 2 mm.

The shape of the tank is not critical but it may conveniently be in the shape of a shallow tray or, preferably U shaped.

It is preferred that the dimensions of the tank be chosen so that the width of the tank is the same as or only just wider than the width of the material being processed.

The total volume of the processing solution within the processing channel and recirculation system is relatively smaller as compared with prior art processes. In particular the total amount of processing solution in the entire processing system for a particular module is such that the total volume in the processing channel is at least 40% of the total volume of the processing solution in the entire system. Preferably the volume of the processing channel is at least about 50% of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leq F/A \leq 23$$

where

F is the flow rate of the solution through the nozzle in liters/minute and

A is the cross sectional area of the nozzle provided in square centimeters.

Providing a nozzle in accordance with the foregoing relationship assures appropriate discharge of the processing solution against the photosensitive material.

Such low volume thin tank systems are described in more detail in the followingreferences: U.S. Pat. No. 5,294,956; U.S. Pat. No. 5,179,404; U.S. Pat. No. 5,270,762; EP-A-559,025; EP-A-559,026; EP-A-559,027; WO92/10790; WO92/17819; WO93/04404; WO92/17370; WO91/19226; WO91/12567; WO9207302; WO93/00612, WO92/07301 and U.S. Pat. No. 5,436,118.

If the residence time of components of the developer solution is defined as the total time needed to reach one tank turnover (1TTO), then it is given by the following formula:

$$1TTO = \frac{V \times 100}{R \times T \times U} \quad (1)$$

where

V is the volume of the processing tank (liter), R is the replenishment rate (liters/m$^2$), T is the transport speed (m$^2$/min) and U is the percent utilization as the percentage of a working day (8 hours) that the processor is running paper.

The processor is idle overnight for 16 hours and this time is part of the total standing time. In the case of conventional processing the chemical loss rates overnight will be lower than during a working day because the temperature is lower and the recirculation is switched off thus reducing aerial oxidation. However there will still be some extra losses overnight that must be taken into account. In the case of an RX developer/amplifier there will also be reduced loss overnight but since RX developer/amplifiers are Generally less stable chemically than conventional developers overnight standing could cause greater sensitometric deterioration. In order to account properly for overnight losses the concept of the average time to reach one tank turnover is proposed. This is defined as 24 hours divided by the number of tank turnovers possible during a working day of eight hours for a particular utilization, replenishment rate and tank volume. This works out simply to be 3 times the time to reach 1TTO during the working day. So equation (1) can be modified to account for this and to convert to hours instead of minutes to give equation (2) below.

$$\text{Average time to } 1TTO = \frac{V \times 100 \times 3}{R \times T \times U \times 60} \quad (2)$$

Table 1 below was constructed to show the relative times for different utilizations and for normal (0.161 liters/m$^2$) and low (0.033 liters/m$^2$) replenishment rates. This latter rate is about the minimum replenishment rate possible in order to maintain tank volume but to produce no overflow. If the volume of the developer tank is reduced to 1.80 liters instead of 22.414 liters, the residence times are correspondingly reduced for the period when the processor is working.

These volumes are those for a standard Kodak Model 52 paper processor (22.414 liters) and a modified Kodak Model 52 processor with a much smaller developer tank (1.80 liters). The word Kodak is a Registered Trade Mark.

The process will normally be carried out with recirculation. The volume of solution in the recirculation system is considered to be a part of the tank volume for the purpose of calculating the residence time.

TABLE 1

| | Residence Time (hours) | | | |
|---|---|---|---|---|
| | Large tank (22.4 1) | | Small tank (1.8 1) | |
| Utilization | low | normal | low | normal |
| 100% | 112.2 | 22.4 | 9 | 1.8 |
| 20% | 561.0 | 112.2 | 45 | 9 |
| 2% | 5610.0 | 1122.0 | 450 | 90 |

If the RX process is run in a conventional processor the average time to turnover a tank must be less than the useful lifetime of the RX developer. The lifetime of the RX developer is 3 days or 72 hours and from Table 1 it can be seen that this is less than the time for 1TTO for a low replenishment rate of 0.0331/m$^2$ even if the processor is running at 100% utilization. At the lowest possible replenishment rate of 0.033 l/m$^2$ this RX developer cannot be used at all in a conventional large tank. The minimum replenishment rate would be 0.0503 l/m$^2$ at 100% utilization.

If the RX process is run in a small volume tank at the normal replenishment rate then it can be used over most of the utilization range down to 2.5%.

This shows that an RX developer that has a useful lifetime of at least 3 days can be used in a small volume tank even at the lowest replenishment rate down to 12.5% utilization.

In the present specification a developer solution is considered to be useful if the D max values for red, green and blue are all at least 80% of the values of a freshly prepared solution and the useful lifetime of a solution is the time taken at 35° C. for the solution to deteriorate to less than 80% of the Dmax values of a fresh solution.

The Dmax values are measured by the well known sensitometric method that measures the color development using a pre-exposed test strip and involves measuring the dye D max values for red, green and blue.

Table 1 shows that an RX developer with a useful lifetime of 3 days can be used at 0.033 $l/m^2$ replenishment rate down to 12.5% utilization that is a large part of the utilization range commonly used in practice.

The following Examples are included for a better understanding of the invention.

EXAMPLE 1

An RX developer was prepared with the composition given in Table 2 below and used as described above. It was found to have a useful lifetime of at least 3 days.

TABLE 2

| Component | Developer | Developer Replenisher | Peroxide Replenisher |
|---|---|---|---|
| AC5 | 0.6 ml/l | 0.9 ml/l | |
| AC8 | 2.0 ml/l | 3.0 ml/l | |
| phosphate | 40.0 g/l | 60.0 g/l | |
| KBr | 1 mg/l | | |
| KCl | 0.5 g/l | | |
| CDS | 0.3 g/l | 0.45 g/l | |
| HAS | 1.0 g/l | 3.45 g/l | |
| KOH (50%) | 10 ml/l | 30 ml/l | |
| CD3 | 4.5 g/l | 10.03 g/l | |
| Tween 80 | 0.4 g/l | 0.6 g/l | |
| Dodecylamine | 0.1 g/l | 0.15 g/l | |
| pH | 11.4 | 11.85 | |
| $H_2O_2$ (30%) | 2.2 ml/l | | 10.23 ml/l |
| Rate | | 0.108 $l/m^2$ | 0.504 $l/m^2$ |
| Process time | 45 seconds | | |
| Temperature | 32° C. | RT | RT |

The phosphate was $K_2HPO_4 3H_2O$, AC5 is a 60% solution of 1-hydroxyethylidene-1,1-diphosphonic acid and AC8 is a 41% solution of the penta sodium salt of diethylene triamine pentaacetic acid. CDS is catechol disulphonate and HAS is hydroxylammonium sulphate. Tween 80 is a trade mark of Atlas Chemical Industries Inc and is a non-ionic surfactant.

The good stability of this RX developer was obtained by:

(i) using hydroxylamine as the antioxidant (ii) by increasing the solution pH from the more usual 10.0 to 11.4 and (iii) using phosphate as the buffer rather than carbonate.

In order to maximize the stability of the RX developer the level of HAS must be minimized since it reacts with peroxide and reduces the activity of the developer. This means that the level of HAS in the developer replenisher (that does not contain peroxide) must also be less than might be desired for the best resistance of this replenisher to aerial oxidation. In addition, aerial oxidation of the developer replenisher causes loss of HAS to a variable extent and thus leads to variable levels of HAS in the developer itself. This can lead to variable sensitometry in the RX developer using HAS as the antioxidant that would be much less apparent with the more usual antioxidant diethylhydroxylamine, since this material has only a small effect on sensitometry. Thus using HAS as the anti-oxidant gives a less stable or variable developer-replenisher compared with that using diethylhydroxylamine. This is the previously unrecognized problem that is solved by the present invention.

EXAMPLE 2

The problem of instability and variability in the developer-replenisher can be overcome if the developer-replenisher is split into parts and these parts are used to replenish the developer directly without being made up into a separate developer-replenisher. These parts are normally designed to have a very long shelf life of the order of years and so this allows a stable developer replenisher and a stable developer to be formulated. A comparison of the loss rates of a made up developer replenisher with those of separate concentrates is shown in Table 3. The made up replenisher was kept in a sealed double walled collapsible container and the concentrates were kept in sealed polypropylene bottles. The loss rates in the separate part cannot be immediately compared with a made up replenisher since the concentrations are very different and so the loss rates are compared by aging the concentrates and then making them up to the same replenisher for analysis. This gives the same effect as using the concentrates plus water added directly to the developer tank.

TABLE 3

| chemical loss rates (g/l/day) | | | | | |
|---|---|---|---|---|---|
| Made-up replenisher | | | Separate Parts | | |
| CD3 | pH | HAS | CD3 | pH | HAS |
| 0.07 | 0.005 | 0.03 | <0.001 | 0 | <0.001 |

These results show that the problem of variability in the chemical levels in the made up developer-replenisher caused by aerial oxidation or other degradation is overcome by replenishing with concentrate plus water directly into the developer tank.

These experiments show that:

1. RX developers using hydroxylamine have a useful lifetime of at least 3 days and therefore only these developers can be used over most of the normal utilization range at reduced replenishment rates or volumes and
2. It is necessary to use a low volume tank and also to add the reduced volumes of replenishment chemicals by adding concentrates or solids directly to the developer tank.

EXAMPLE 3

A made up replenisher using HAS as the antioxidant, similar to that shown in Table 2, was made more concentrated in order to add smaller volumes and have a lower total replenishment rate. The amount to which this can be done was severely limited by the solubility of the color developer CD3 at pH 11.4. The use of concentrate addition directly to the developer tank avoided this problem and also allowed the addition of small volumes required to achieve the minimum replenishment rate of 0.033 $l/m^2$. Thus the use of concentrate not only allows a stable replenishment system to be set up as described in Example 1 but also allows minimum replenishment rates to be realized at the same time.

The composition of the concentrates is shown below.

| Part A<br>140 ml to make 1 liter of developer-replenisher | |
|---|---|
| demineralized water | 475 ml |
| AC5 | 6.4 g |
| AC8 | 21.5 ml |
| $K_2HOP_4.3H_2O$ | 428.6 g |
| KOH (solid) | 188.8 g |
| demineralized water to 1 liter | |
| **Part B**<br>12.79 ml to make 1 liter of developer-replenisher | |
| demineralized water | 800 ml |
| HAS | 270 g |
| demineralized water to 1 liter | |
| **Part C**<br>42.16 ml to make 1 liter of developer replenisher | |
| demineralized water | 700 ml |
| $K_2SO_3$ (anhydrous) | 2.4 g |
| CD3 | 238 g |
| demineralized water to 1 liter. | |
| **Part D**<br>10.0 ml to make 1 liter of replenisher | |
| water | 500 ml |
| dodecylamine | 15 g |
| acetic acid | 4.9 g |
| These are mixed and added to the water | |
| Tween ™ 80 | 60 g |
| water to 1 liter | |

The hydrogen peroxide is kept separate from the developer replenisher as indicated in Table 2 and this would still be the case when using concentrates for direct replenishment.

| Peroxide Part | |
|---|---|
| hydrogen peroxide (30%) | 10.21 ml |
| demineralized water to 1 liter | |

These are the concentrates that would be used to make up a conventional replenisher as indicated by the amounts to use to make one liter of developer replenisher. These concentrates can also be used for a direct replenishment system without the need for an intermediate replenisher by using the following addition rates.

| | |
|---|---|
| Part A | 3.01 ml/m$^2$ |
| Part B | 2.19 ml/m$^2$ |
| Part C | 0.9 ml/m$^2$ |
| Part D | 0.215 ml/m$^2$ |
| Peroxide | 25.9 ml/m$^2$ |

Solid replenishment that is a convenient, accurate and consistent means of maintaining a developer is ideally suited to be used in combination with RX developers, low volume tanks and minimum replenishment rates. The replenishers contain components such as AC5, AC8 and hydrogen peroxide that have traditionally been available as solutions. All these are available as solids, AC5 is available as the solid sodium salt (although it would have to be converted to the potassium salt because the mixed calcium/sodium salt is prone to precipitate in developer solutions), AC8 is available as the solid free acid, "pentetic acid" and the hydrogen peroxide can be supplied as the urea:hydrogen peroxide complex. Experiments have shown that urea has no effect on the performance or stability of the RX developers so constituted. Thus the replenishment could be accomplished entirely by the addition of solids plus water or in part by the addition of some solids and some solutions.

Thus the overall system described allows the use of relatively stable RX developers in low volume tanks, with minimum replenishment rate either by means of liquid concentrates or solids, that can be used over most of the useful range of utilization.

EXAMPLE 4

A developer/amplifier as described in Example 1 was replenished with the solids listed below together with some water.

These solids can be added individually or combined together as a composite solid that is then added to the tank. In addition an appropriate amount of water is added. The addition rates for these solids and water to achieve an overall replenishment rate equivalent to 32 ml/m$^2$ are as follows:

| | |
|---|---|
| $K_3AC5$ | 15.9 mg/m$^2$ |
| DTPA | 26.2 mg/m$^2$ |
| $K_2HPO_4.3H_2O$ | 1.29 g/m$^2$ |
| KOH | 0.57 g/m$^2$ |
| HAS | 0.59 g/m$^2$ |
| $K_2SO_3$ | 2.16 mg/m$^2$ |
| CD3 | 0.214 g/m$^2$ |
| Dodecylamine | 3.22 mg/m$^2$ |
| Texofor ™ FN3O | 12.0 mg/m$^2$ |
| Urea hydrogen peroxide | 0.24 g/m$^2$ |
| demineralized water | 32.2 ml/m$^2$ |

where $K_3AC5$ is the dipotassium salt of 1-hydroxyethylidene-1, 1-diphosphonic acid, DTPA is diethylene triamine pentaacetic acid and urea hydrogen peroxide is a 1:1 addition compound of urea and hydrogen peroxide. Texofor FN30 is a solid non-ionic surfactant of similar function to Tween 80.

Consistent sensitometric results were obtained over a period of 1 week.

The invention has been described in detail with particular reference to preferred embodiments thereof, but it will be understood that variations and modifications can be effected within the spirit and scope of the invention.

I claim:

1. A process for the formation of a dye image by a redox amplification process in an imagewise exposed photographic color material having at least one silver halide layer and associated therewith a dye image-forming color coupler, the process comprising treating said material in a processing tank containing a color developer solution containing a color developing agent and hydroxylamine as developing agent preservative, and wherein said color developer solution is replenished with a color developer replenisher, said process being carried out in a tank in which the ratio of the tank volume to maximum area of material accommodatable therein is less than 11 dm$^3$/m$^2$, and said color developer replenisher is added as solids or liquid concentrates directly to said color developer solution with or without additional water.

2. The process of claim 1 wherein the ratio of the tank volume to maximum area of material accommodatable therein is less than 3 dm$^3$/m$^2$.

3. The process of claim 1 wherein said color developer solution is a combined developer/amplifier solution.

4. The process of claim 1 wherein said color developer solution is recirculated through said processing tank.

5. The process of claim 3 wherein said combined developer/amplifier solution comprises a redox oxidizing agent which is hydrogen peroxide or a compound that provides hydrogen peroxide, and in which the hydrogen peroxide replenisher is added as either a solid or a liquid.

6. The process of claim 5 wherein replenisher is added to said combined developer/amplifier solution as at least two separate components.

7. The process of claim 1 wherein the color developer solution replenishment rate is from less than 215 ml/m$^2$ down to the rate necessary to maintain tank volume but produce no overflow.

8. The process of claim 3 wherein the components of said combined developer/amplifier solution are selected to give a solution having a useful lifetime at 35° C. of at least 3 days, said useful lifetime being the time for which the D max values for red, green and blue all remain at at least 80% of the values produced by a freshly prepared solution.

9. The process of claim 8 in which the average residence time of said combined developer/amplifier solution in the developing tank is defined by the formula:

$$\text{Average residence time} = \frac{V \times 100 \times 3}{R \times T \times U \times 60} \quad (1)$$

where

V is the volume of the processing tank (liters), R is the replenishment rate (liters/m$^2$), T is the transport speed (m$^2$/min) and U is the percent utilization as the percentage of a working day (8 hours) that the processor is running, and said average residence time is less than the useful lifetime of said combined developer/amplifier solution, the useful lifetime of said solution being the time taken at 35° C. for it to deteriorate to less than 80% of the Dmax values provided by a fresh solution.

10. A process of claim 1 wherein said material is a color paper material.

11. The process of claim 10 wherein said color paper material has at least one emulsion layer comprising more than 80 mol % silver chloride.

12. The process of claim 11 wherein said color paper material has at least one emulsion layer comprising more than 90 mol % silver chloride.

13. The process of claim 1 wherein said color developer solution has a pH of from 11 to 11.7.

14. The process of claim 1 wherein said material has a total silver coverage of from 6 to 300 mg/m$^2$.

15. The process of claim 1 wherein said material has a total silver coverage of from 10 to 100 mg/m$^2$.

16. The process of claim 1 wherein said material is a color paper comprising silver halide emulsions, each having a silver chloride content of at least 85 mol %, and the total silver coverage being from 50 to 90 mg/m$^2$.

17. The method of claim 5 wherein said hydrogen peroxide is present in an amount of from 0.5 to 2 ml/l, when used as a 30% (by weight) solution.

18. The method of claim 1 wherein said hydroxylamine is present in an amount of from 0.5 to 8 g/l.

19. The method of claim 1 wherein said hydroxylamine is present as hydroxylamine chloride, hydroxylamine phosphate or hydroxylamine sulfate.

20. The method of claim 1 wherein said color developer solution additionally includes either a carbonate in an amount of from 10 to 60 g/l, or a phosphate in an amount of from 20 to 80 g/l.

* * * * *